US005466536A

United States Patent [19]

Berner et al.

[11] Patent Number: 5,466,536

[45] Date of Patent: Nov. 14, 1995

[54] REVERSE SIDE COATING FOR PHOTOGRAPHIC SUPPORT

[75] Inventors: Hans-Ulrich Berner, Hilter; Rolf Ebisch, Osnabrück; Eckehard Saverin, Osnabruck; Udo Tyrakowski, Hasbergen, all of Germany

[73] Assignee: Felix Schoeller jr Papierfabriken GmbH & Co. KG, Osnabruck, Germany

[21] Appl. No.: 207,549

[22] Filed: Mar. 8, 1994

[30] Foreign Application Priority Data

Mar. 16, 1993 [DE] Germany ..... 43 08 274.2

[51] Int. Cl.[6] ..... G03C 1/85

[52] U.S. Cl. ..... 428/522; 428/520; 430/271; 430/275; 430/278; 430/523; 430/527; 430/529; 430/530; 430/536; 430/538

[58] Field of Search ..... 430/527, 271, 430/275, 278, 523, 529, 530, 536, 538; 428/520, 522

[56] References Cited

U.S. PATENT DOCUMENTS 5,232,824 8/1993 Saverin et al. ..... 430/527

5,286,618 2/1994 Tachibana et al. ..... 430/527

FOREIGN PATENT DOCUMENTS 160912 4/1985 European Pat. Off. .

495314 7/1992 European Pat. Off. .

3700183 7/1988 Germany .

*Primary Examiner*—Charles L. Bowers, Jr.

*Assistant Examiner*—Christopher G. Young

*Attorney, Agent, or Firm*—Lockwood, Alex, Fitzgibbon & Cummings

[57] ABSTRACT

A photographic support material has a reverse side layer which includes a polymer having a film formation temperature which does not exceed 70° C., and a conductive material. The polymer may be a mixture of polymers or copolymers of styrene, alkylstyrene, (meth)acrylic acid and (meth)acrylic acid alkylester. The conductive material may be an alkali salt of a crosslinkable polysulfonic or polystyrene sulfonic acid or a coated or uncoated metal oxide from the group of metals of the 2nd to 4th main or sub groups, and may also contain a polyfunctional aziridin. The reverse side layer can be printed with thermal printers with only slight absorption of dirt and discoloration from developer baths, and has good adhesion of adhesive tape, good printability with conventional printers, good resistance to abrasion and baths, and a good antistatic properties.

24 Claims, No Drawings

REVERSE SIDE COATING FOR PHOTOGRAPHIC SUPPORT

BACKGROUND AND DESCRIPTION OF INVENTION

The present invention relates to a reverse side coating for a photographic support material, as well as a coating mass for the reverse-side of photographic support materials.

The support material can be a plastic coated paper or a plastic foil. The reverse side is the surface of the support material which is opposite the image bearing front side.

Papers which are extrusion coated on their front and reverse sides with polyolefin layers are conventionally used as supports for light sensitive layers. The polyolefins can be polyethylenes, such as LDPE, LLDPE, HDPE, and polypropylene or mixtures of these components. Plastic foils, however, are also suited as support materials. The polyolefin coated base papers must have certain characteristics because of the further processing to which they are subjected.

It is necessary that the photographic materials which are to be developed be marked on the reverse side of the support material by means of writing or printing in order for them to be assigned to specific clients and customers. However, hydrophobic coating which comprises polyolefin and seals the paper core can only be labelled or identified to a limited extent. Special measures and means are necessary in order for a general printability or writability to be guaranteed during the machine processing of the photographic material.

The processing of photographic papers which is carried out in so-called "minilabs" particularly imposes requirements on the reverse side of the paper. These minilabs have a complicated paper path with numerous transporting and reversing rollers which mechanically severely stress the paper. This leads to abrasion with the consequence of disruptions of transport and wastage. Thus, there is a requirement that a reverse side layer be especially hard and resistant to abrasion.

It is also necessary that the photographic material which is coated with light sensitive emulsions have no dirt particles ("tar stains") accumulate on its surface from the various treatment baths during the development process. Such particles form in aged photographic treatment baths because of oxidation and condensation processes over the passage of time.

Another requirement for such types of photographic support materials is good adhesion capability for adhesive strips which serve for attachment of the photographic paper strips, which are present in rolls, to one another. The adhesions should not loosen during the development process and during the passage through the aqueous bath fluids.

Another requirement is the antistatic finishing of the photographic papers. Discharge which would lead to the nonusability of the light sensitive emulsion or to the destruction of the latent image which is to be developed should be prevented during the passage of the plastic coated photographic support materials through the emulsion applying machine or through the developing machines. An antistatic effect is desirable which persists even after passage through the development baths. With this antistatic effect, further processing of the images during cutting and during passage through high speed sorting machines is possible without disturbances from "electrostatic adhesion".

Still another requirement is printability with thermal printers which transfer printing inks at high temperatures during short periods of time.

In summary, a reverse side layer or coating must confer upon the photographic support materials the following characteristics: writability, printability, thermal printability, adhesive strip adhesion, resistance to abrasion and antistatic finishing both before and after developer baths. In addition the absorption of dirt from tar-like oxidation products from the development baths must be avoided.

It is known that the requirements of a reverse side layer which have been described above require different measures and means to satisfy them and which are frequently contradictory to one another.

It is known from the European patent publication EP-OS 01 60 912 to provide a polyethylene coated photographic material on the reverse side with an antistatic layer, which consists of a sodium magnesium silicate, a sodium polystyrene sulfonate and certain succinic acid semiesters. This layer should prevent electrostatic charging and protect the material against the absorption of dirt. However it has a poor adhesive strip adhesion, a low resistance to baths and unsatisfactory thermal printability.

A photographic support material with a reverse side layer which has good antistatic and printability properties, from average to good resistance to abrasion and to baths, as well as good adhesive strip adhesion is described in the German patent publication DE-OS 37 00 183. However, the absorption of dirt ("tar stains") in various developers is high and the thermal printability is unsatisfactory.

A photographic recording material which should have improved antistatic characteristics and which is also not impaired by means of the treatment in a developer solution is described in the European patent publication EP 0 495 314. The improved antistatic characteristics should be achieved with the help of a conductive layer which may contain a water soluble polymer and a metallic oxide. The bonding agents which are used in this case may be the following bonding agents:

Proteins, cellulose compounds, saccharides, synthetic polymers, such as polyvinyl alcohol, polacrylate, polystyrene, polyester, polyvinyl chloride, or terpolymers, such as, for example, styrene/acrylic acid ester/acrylic acid terpolymer, and acrylic acid ester/acrylic nitrile/acrylic acid terpolymer.

The material which is disclosed in this publication in fact does have very good antistatic characteristics. However, its resistance to abrasion and its printability are unsatisfactory.

It is thus an object of the present invention to produce a photographic support material with a reverse side layer or coating which fulfills all of the requirements which have been described above, such as good printability for printing strips, thermal printability, copolymer antistatic finishing both before and after development baths, good adhesive strip adhesion, resistance to abrasion, and low absorption of dirt ("tar stains").

This task is solved by a reverse side layer which contains a copolymer with a minimum film, formation temperature of no more than 70° C. as a bonding agent, and a conductive substance.

The copolymer can be a styrene/alkylstyrene/(meth-)acrylic acid/(meth)acrylic acid alkylester copolymer, or a mixture of various styrene/alkylstyrene/(meth)acrylic acid/(meth)acrylic acid alkylester copolymers. In one particular embodiment of the invention, the copolymer comprises at least two styrene/alkylstyrene/(meth)acrylic acid/(meth-)acrylic acid alkylester copolymers with various contents of (meth)acrylic acid. The copolymer should contain at least 3 to 70 mol percent (meth)acrylic acid, and preferably 5 to 40 mol percent.

The reverse side layer in accordance with the invention can contain an alkali salt of an organic polyacid, especially a sodium salt of a polysulfonic acid or polystyrene sulfonic acid, as a conductive substance. The quantity of the alkali salt of an organic polyacid in the dry layer can be up to 10 weight percent.

In one preferred embodiment of the invention, the copolymer comprises 75 to 95 parts of a styrene/alkylstyrene/(meth)acrylic acid/(meth)acrylic acid alkylester copolymer, with a content of (meth)-acrylic acid of 3 to 10 mol percent, and 25 to 5 parts of a styrene/alkylstyrene/(meth)acrylic acid/(meth)acrylic acid alkylester copolymer with a content of (meth)acrylic acid of 30 to 40 mol percent.

In one other embodiment of the invention, the reverse side layer can be an oxide of a metal of the 2nd to 4th main or sub group. Metallic oxides selected from the group of ZnO, $TiO_2$, $SnO_2$, $Al_2O_3$, $In_2O_3$, MgO, BaO or mixtures thereof are examples.

In one preferred embodiment of the invention, the metallic oxide is coated with another metallic oxide from the group of the metals of the 2nd to 4th main group, and can contain a doping agent incorporated into the crystal lattice of the metallic oxide. The doping agents may be, for example, niobium, tantalum, indium, aluminum, and particularly antimony. Particularly good results were attained with tin oxide with antimony as the doping agent.

The same applies for a titanium dioxide which is coated with an oxide of a metal of the 4th main group which can contain a doping agent. Acicular titanium oxide coated with tin oxide ($SnO_2$), with antimony (Sb) as a doping agent, is particularly suitable. The diameter of the $TiO_2$ particles is preferably 0.05 to 0.10 μm, and the length of the particles is 3.0 to 6.0 μm.

The reverse side layer can additionally contain a colloidal silicic acid, particularly an aluminum modified silicic acid with a particle size of 7 to 16 nm and in a quantity of up to 50 weight percent (relative to the dry layer). The modification preferably comprises the exchange of a few silicon atoms by aluminum atoms.

The reverse side layer in accordance with the present invention can contain silicates, particularly a sodium aluminum silicate with primary particles of 10 to nm and in a quantity of up to 5 weight percent in relation to the dry layer.

The reverse side layer in accordance with the present invention can additionally contain a polyfunctional aziridin and a wetting agent. Among the polyfunctional aziridins, trifunctional aziridins are particularly preferred.

The aqueous coating mass for the production of the reverse side layer in accordance with the invention in one particular implementation comprises the following components:

an aluminum modified colloidal silicic acid;

a silicate with primary particles of 10 to 20 nm;

an alkali salt of an organic polyacid;

a polyfunctional aziridin; and a plastic dispersion which contains a styrene/alkylstyrene/(meth)acrylic acid/(meth)acrylic acid alkylester copolymer, or a mixture of at least two different styrene/alkylstyrene/(meth)acrylic acid/(meth)acrylic acid alkylester copolymers, the minimum film formation temperature of which is no more than 70° C.

The individual components in the aqueous coating mass are present in the following quantities:

| | |
|---|---|
| Plastic dispersion, as 50 wt % aqueous dispersion | 2–13 wt %; |
| Aluminum modified colloidal silicic acid, as 30 wt % dispersion | 2.5–10 wt %; |
| Silicate, as 10 wt % dispersion | 1–5 wt %; |
| Polyfunctional aziridin, as 50 wt % dispersion | 0.05–0.4 wt %; |
| Alkali salt of an organic polyacid, as 30 wt % dispersion | 0.5–4.0 wt % |
| Water | remainder |

One other coating mass for the production of the reverse side layer in accordance with the invention comprises the following components:

a plastic dispersion which contains a styrene/alkylstyrene/(meth)acrylic acid/(meth)acrylic acid alkylester copolymer, or a mixture of at least two different styrene/alkylstyrene/(meth)acrylic acid/(meth)acrylic acid alkylester copolymers, the film formation temperature of which is no more than 70° C.;

a polyfunctional aziridin;

a metallic oxide from the group of the metals of the 2nd to 4th main or sub groups.

The individual components in the aqueous coating mass are present in the following quantities:

| | |
|---|---|
| Plastic dispersion, as 50 wt % aqueous dispersion | 2–13 wt %; |
| Polyfunctional aziridin, as 50 wt % dispersion | 0.05–0.4 wt %; |
| Metallic oxide, of 100 wt % | 2.5–15 wt %; |
| Water | remainder |

The basic recipes described above can be supplemented by further additions in order to reinforce the characteristics or to produce other characteristics. Such additives may be optical brighteners, toning dyes, coloring agents, matting agents, white pigments, crosslinking agents and similar auxiliary agents.

The coating mass in accordance with the invention is applied onto a support, preferably onto a resin coated paper support, such as polyethylene coated base paper. All conventional systems are suitable for the application of the coating masses. The surface of the photographic support material which is to be coated is preferably pretreated by means of corona discharge in order to secure a better adhesion of the layer which is applied.

EXAMPLE 1

A support material consisting of a highly sized base paper with 160 g/m$^2$ basis weight, a pigmented polyethylene layer (30 g/m$^2$) on the front side, and an unpigmented polyethylene layer (35 g/m$^2$) on the reverse side, was coated on the reverse side, after a corona-type preliminary treatment, with the following coating masses:

| Components, wt % | Examples | |
|---|---|---|
| | 1a | 1b |
| Demineralized water | 80.14 | 75.84 |
| Wetting agent, 10 wt % in MEOH (Surfynol 440, Biesterfeld & Co.) | 0.96 | 0.96 |
| Na—Al-silicate, 10 wt % in water (Pasilex, Degussa AG) | 2.0 | 2.0 |

-continued

| Components, wt % | | |
|---|---|---|
| Colloidal Al-modified silicic acid, 30 wt % in water (Ludox AM, E.I. DuPont) | 6.0 | 10.0 |
| Copolymer I[1], 50 wt % dispersion in water (Carboset XPD 1339, BF Goodrich Chem.) | 4.9 | 4.9 |
| Copolymer II[2], 15 wt % dispersion in water (Carboset XPD 1161, BF Goodrich Chem.) | 4.0 | 4.0 |
| Sodium polystyrene sulfonate, 30 wt % in water (Versa TL 77, Nat. Starch & Chem. Co.) | 1.8 | — |
| Sodium naphthalin trisulfonate, 30 wt % in water | — | 2.1 |
| Trifunctional aziridin, 50 wt % in IPA (Xama 7, Celanese Virginia Chem.) | 0.2 | 0.2 |

| 1-Copolymer I is: | | Mol % |
|---|---|---|
| Styrene | | 54 |
| Amylstyrene | | 8 |
| 2-Ethylhexacrylate | | 30 |
| Acrylic acid | | 8 |
| Molecular weight | >500 000 | |
| Film formation temp. | 30° C. | |
| Acid number | 50 | |
| **2-Copolymer II is:** | | **Mol %** |
| Styrene | | 23 |
| α-Methylstyrene | | 23 |
| Butylacrylate | | 21 |
| Acrylic acid | | 33 |
| Molecular weight | 4000 | |
| Film formation temp. | 80° C. | |
| Acid number | 210 | |

The coating masses were applied with a roll coater system onto the surface to be coated, measured out with a doctor bar, and dried in a hot air channel at air temperatures of approximately 80° C. The speed of the machine was 100 m/min. The application weight of the dried layer was 0.2±0.1 g/$m_2$.

The finished samples were subsequently investigated and the test results are summarized in Table 1.

EXAMPLE 2

A support material in accordance with Example 1 was coated, after a corona-type preliminary treatment, with the following coating masses:

| | Examples | | | | | |
|---|---|---|---|---|---|---|
| Components, wt %: | 2a | 2b | 2c | 2d | 2e | 2f |
| Demineralized Water | 87.5 | 86.0 | 90.88 | 77.1 | 79.85 | 84.88 |
| Wetting agent, 10 wt % in MEOH | 1.0 | 1.0 | 1.0 | 1.0 | 1.0 | 1.0 |
| Metallic oxide I*, 100 wt % | 2.5 | 4.0 | 4.0 | 4.0 | 15.0 | — |
| Metallic oxide II**, 100 wt % | — | — | — | — | — | 10.0 |
| Copolymer I, 50 wt % dispersion in water | 4.9 | 4.9 | 2.5 | 9.8 | 2.5 | 2.5 |
| Copolymer II, 15 wt % dispersion in water | 4.0 | 4.0 | 1.55 | 8.0 | 1.55 | 1.55 |
| Trifunctional aziridin, 50 wt % in IPA | 0.1 | 0.1 | 0.07 | 0.1 | 0.1 | 0.07 |

-continued

*Metallic oxide I is: Acicular $TiO_2$ surface treated with $SnO_2$ and doped with Sb (FT-1000, Ishihara Sangyo, Kaisha, Ltd.).
**Metallic oxide II is: $SnO_2$ doped with Sb (T1 - Powder, Mitsubishi Metal Corporation).

The coating masses were applied under the same conditions as in Example 1. The results of the investigation of the finished samples are summarized in Table 1.

Comparative Examples

The following comparative examples were selected:

Comparative Example V1 =Example 2.1, from EP-OS 160 912

Comparative Example V2 =Example 1, from DE-OS 37 00 183

Comparative Example V3 =Example 1 (U2), from EP-OS 0 495 314

The test results are summarized in Table 1.

Test Methods

1. Anti-static Characteristics

The test of the antistatic characteristics was carried out by means of the measurement of the surface resistance with an electrode in accordance with DIN 53 482.

For the goal parameter for the evaluation of the antistatic finishing of the material before the development process, a conductivity value of $10^9$–$10^{11}$ Ωcm is applicable, and after the development process, a value of $<10^{13}$ Ωcm is applicable.

2. Dirt Absorption (Tar Stain)

In this test, various color developers of the commercially conventional type from Europe, Japan and the USA were added to an open basin and allowed to stand open to the air for a period of one week. The samples to be tested were then drawn over the tar-like oxidation products which had formed on the surface of the developer during the intervening time, and the samples were subsequently washed under flowing water and dried in air. The dirt remaining on the sample was visually evaluated with the grades of 1 to 5, whereby 1 is "very good" and 5 is "unsatisfactory".

3. Discoloration

After the passage of the samples through the automatic developers and the subsequent storage of the samples, the discoloration of the reverse side layer by the photographic development process was visually evaluated for 4 days in air at room temperature (Grades 1 to 5).

4. Adhesive Strip Adhesion

An adhesive strip of the commercially available type was used for the test. The adhesive strip was pressed on the reverse side layer and pressed with a weight of 3 kilograms. The sample adhered to the adhesive strip was subsequently cut into strips 1.5 cm wide, and the adhesive strip was withdrawn from the sample in a breaking load testing device at an angle of 180° and at a speed of 20 cm/min. The force required for the removal was measured. A force of more than 1.5N/15 mm was evaluated as "good".

5. Printability

The test for the printability was carried out with colored ribbons of the commercially available type. The printed samples were immersed for 30 seconds in a developer of the type which is commercially conventional. After that, the printed image was lightly brushed over by finger and then subsequently washed with water. Blurrings or discolorations served for the visual evaluation of the printability of the samples (Grades 1 to 5).

6. Resistance to Abrasion and Developer Baths

Printed samples (see test for Printability) were immersed for 30 seconds in a commercially conventional developer and subsequently rinsed with water. The resistance to abrasion and the developer bath were determined by intensive rubbing with the finger on the printed and moist surface of the samples (Grades 1 to 5).

In comparison with the reverse side layers which are described in the state of the art, all of the reverse side layers in accordance with the invention range from "good" to "very good" with respect to the requirements for such products (see Table 1).

TABLE 1

| | TEST RESULTS | | | | | | | | | | |
|---|---|---|---|---|---|---|---|---|---|---|---|
| Test Method | 1a | 1b | 2a | 2b | 2c | 2d | 2e | 2f | V1 | V2 | V3 |
| Conductivity, Ω cm | | | | | | | | | | | |
| before development | $2 \times 10^{11}$ | $3 \times 10^{10}$ | $10^{11}$ | $6 \times 10^{7}$ | $8 \times 10^{10}$ | $1 \times 10^{8}$ | $<10^{7}$ | $1 \times 10^{9}$ | $2 \times 10^{9}$ | $2 \times 10^{10}$ | $1 \times 10^{8}$ |
| after development | $10^{13}$ | $4 \times 10^{12}$ | $8 \times 10^{12}$ | $2 \times 10^{9}$ | $3 \times 10^{13}$ | $3 \times 10^{9}$ | $<10^{7}$ | $2 \times 10^{9}$ | $1 \times 10^{11}$ | $8 \times 10^{10}$ | $2 \times 10^{9}$ |
| Dirt Absorption | 2.5 | 1 | 1 | 1 | 2 | 1 | 3 | 2.5 | 2 | 3 | 3 |
| Discoloration from Developer | 2 | 2 | 2 | 2 | 2 | 2 | 2 | 2 | 3 | 3 | 2 |
| Adhesion of Adhesion Strip, N/15 mm | 3.2 | 3.8 | 4.1 | 4.1 | 4.1 | 4.1 | 2.4 | 2.3 | 0.1 | 3.4 | 0.5 |
| Printability | 1 | 2.5 | 1 | 1 | 1 | 1 | 1 | 1 | 3 | 2 | 3 |
| Printability with Thermal Printer | 1 | 1 | 1 | 1 | 1 | 1 | 1 | 1 | 5 | 2 | 4 |
| Resistance to Abrasion and Developer Baths | 1 | 1 | 1 | 2 | 2 | 2 | 2 | 2 | 4 | 2 | 3 |

We claim:

1. A photographic support material comprising a base material having a front side and a reverse side opposite the front side, said front side being adapted to receive a light sensitive layer, wherein the improvement comprises:

said reverse side having a layer applied directly thereon comprising a bonding agent including a copolymer comprising a mixture of styrene, alkylstyrene, (alkyl)acrylic acid and (alkyl)acrylic acid alkylester.

2. The photographic support material of claim 1, wherein said bonding agent contains at least 3 mol % (alkyl)acrylic acid.

3. The photographic support material of claim 1, wherein said bonding agent comprises at least two copolymers, a first copolymer being 75 to 95 parts of a styrene/alkylstyrene/(alkyl)acrylic acid/(alkyl)acrylic acid alkylester copolymer with an (alkyl)acrylic acid content of 3 to 10 mol %, and the second copolymer being 25 to 5 parts of styrene/alkylstyrene/(alkyl)acrylic acid/(alkyl)acrylic acid alkylester copolymer with an (alkyl)acrylic acid content of 30 to 40 mol %.

4. The photographic support material of claim 3, including a conductive material comprising an alkali salt of a crosslinkable polysulfonic acid or polystyrene sulfonic acid.

5. The photographic support material of claim 4, wherein the conductive material is present in an amount of up to 15 wt %.

6. The photographic support material of claim 3, wherein the reverse side layer contains an aluminum modified colloidal silicic acid in an amount of up to 50 wt %, and a silicate with primary particles of 10 to 20 nm and in an amount of up to 7 wt %.

7. The photographic support material of claim 3, wherein the reverse side layer also includes a polyfunctional aziridin and a wetting agent.

8. The photographic support material of claim 1, including a conductive material comprising an alkali salt of a crosslinkable polysulfonic acid or polystyrene sulfonic acid.

9. The photographic support material of claim 8, wherein the conductive material is present in an amount of up to 15 wt %.

10. The photographic support material of claim 8, wherein the reverse side layer contains an aluminum modified colloidal silicic acid in an amount of up to 50 wt %, and a silicate with primary particles of 10 to 20 nm and in an amount of up to 7 wt %.

11. The photographic support material of claim 8, wherein the reverse side layer also includes a polyfunctional aziridin and a wetting agent.

12. The photographic support material of claim 1, wherein the reverse side layer contains an aluminum modified colloidal silicic acid in an amount of up to 50 wt %, and a silicate with primary particles of 10 to 20 nm and in an amount of up to 7 wt %.

13. The photographic support material of claim 12, wherein the reverse side layer also includes a polyfunctional aziridin and a wetting agent.

14. The photographic support material of claim 1, including a conductive substance comprising a metallic oxide from the group of the metals of the 2nd to 4th main or sub groups.

15. The photographic support material of claim 14, wherein the metallic oxide contains a doping agent.

16. The photographic support material of claim 14, wherein the metallic oxide is surface treated with a metallic oxide of a metal of the 2nd to 4th main group.

17. The photographic support material of claim 16, wherein the metallic oxide includes an acicular $TiO_2$coated with an oxide of a metal of the 4th main group.

18. The photographic support material of claim 17, wherein the coated metallic oxide includes a doping agent of Sb.

19. The photographic support material of claim 17, wherein the metallic oxide is present in an amount of 30–80 wt % of the reverse side layer.

20. The photographic support material of claim 17, wherein the reverse side layer also includes a polyfunctional aziridin and a wetting agent.

21. The photographic support material of claim 14, wherein the metallic oxide is present in an amount of 30–80 wt % of the reverse side layer.

22. The photographic support material of claim 14, wherein the reverse side layer also includes a polyfunctional aziridin and a wetting agent.

23. The photographic support material of claim 1, wherein the reverse side layer also includes a polyfunctional aziridin and a wetting agent.

24. The photographic support material of claim 1, wherein said copolymer has a minimum film formation temperature which does not exceed 70° C.

* * * * *

UNITED STATES PATENT AND TRADEMARK OFFICE

CERTIFICATE OF CORRECTION

PATENT NO. : 5,466,536

DATED : November 14, 1995

INVENTOR(S) : Hans-Ulrich Berner, Rolf Ebisch, Eckehard Saverin and Udo Tyrakowski It is certified that error appears in the above-indentified patent and that said Letters Patent is hereby corrected as shown below:

Col. 1, line 9, delete "reverse-side" and insert --reverse side--.
Col. 3, line 45, after "to" insert --20--.
Col. 4, line 63, delete "MEOH" and insert --MeOH--.
Col. 5, line 58, delete "MEOH" and insert --MeOH--.
Col. 6, lines 1-5, delete --Examples Components, wt %: 2a 2b 2c 2d 2e 2f--.

Cols. 7-8, TABLE 1, under "Conductivity" indent "before development" and "after development" for clarity.

Signed and Sealed this

Second Day of September, 1997

Bruce Lehman

*Attest:*

BRUCE LEHMAN

*Attesting Officer*

*Commissioner of Patents and Trademarks*